United States Patent [19]

Best et al.

[11] 4,428,212

[45] Jan. 31, 1984

[54] CYLINDER LOCK RETRACTOR AND CHASSIS ASSEMBLY

[75] Inventors: Walter E. Best; William R. Foshee, both of Indianapolis, Ind.

[73] Assignee: Best Lock Corporation, Indianapolis, Ind.

[21] Appl. No.: 309,564

[22] Filed: Oct. 8, 1981

[51] Int. Cl.[3] ..... E05B 9/10; E05B 17/04; E05B 17/08; E05C 1/12

[52] U.S. Cl. ..... 70/224; 70/380; 70/464; 292/169.15; 292/336.5

[58] Field of Search ..... 70/224, 379 R, 380, 70/464; 292/169.15, 169.16, 169.17, 169.21, 169.22, 169.23, 336.5

[56] References Cited

U.S. PATENT DOCUMENTS

| | | | |
|---|---|---|---|
| 3,126,217 | 3/1964 | Russell et al. | 292/1 |
| 3,287,046 | 11/1966 | Russell et al. | 292/169 |
| 3,287,047 | 11/1966 | Russell et al. | 292/169 |
| 3,292,959 | 12/1966 | Russell et al. | 292/1 |
| 3,459,448 | 8/1969 | Russell et al. | 292/336.5 |
| 3,487,667 | 1/1970 | Russell et al. | 70/464 |
| 3,955,387 | 5/1976 | Best et al. | 70/224 |

*Primary Examiner*—Robert L. Wolfe

*Attorney, Agent, or Firm*—Barnes & Thornburg

[57] ABSTRACT

A cylinder lock chassis is composed of three self-contained subassembly units, namely, a central retractor assembly and two "face assemblies" such as inside and outside knob assemblies or others prepared to provide various different "functions" for the lock. The retractor assembly has a retractor held and guided in a frame by guide means, preferably a pair of guide lugs on low-friction shoes riding in guide slots in spaced walls of the frame. The unitary retractor assembly is clamped between end plates of selected face assembly units and interlocked therewith so as to hold the face assemblies in coaxial relation with each other and the retractor unit. This permits selective assembly of various lock chassis from stocks of different self-contained and unitary subassemblies to facilitate original manufacture of locks with different functions, and allows interchange of unitary subassemblies in field service.

20 Claims, 7 Drawing Figures

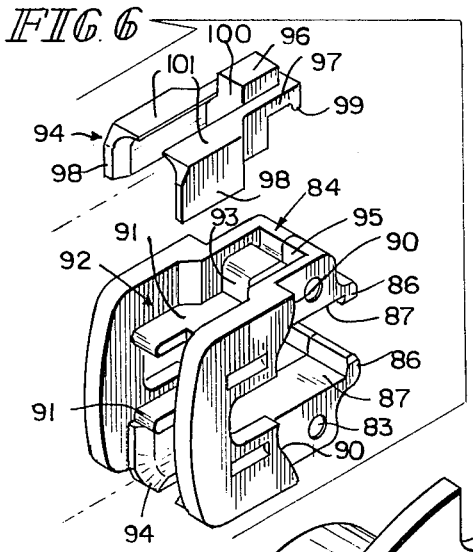
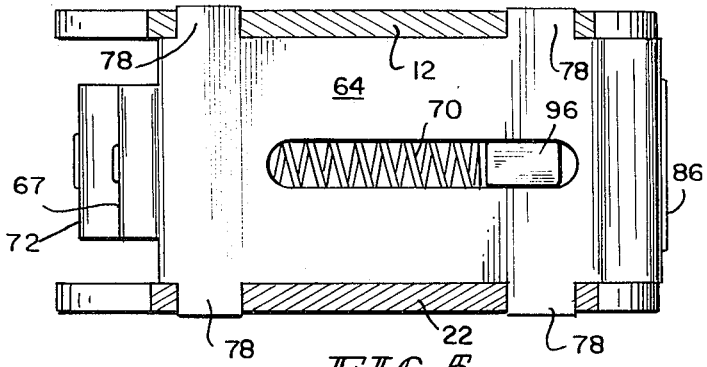
FIG. 5
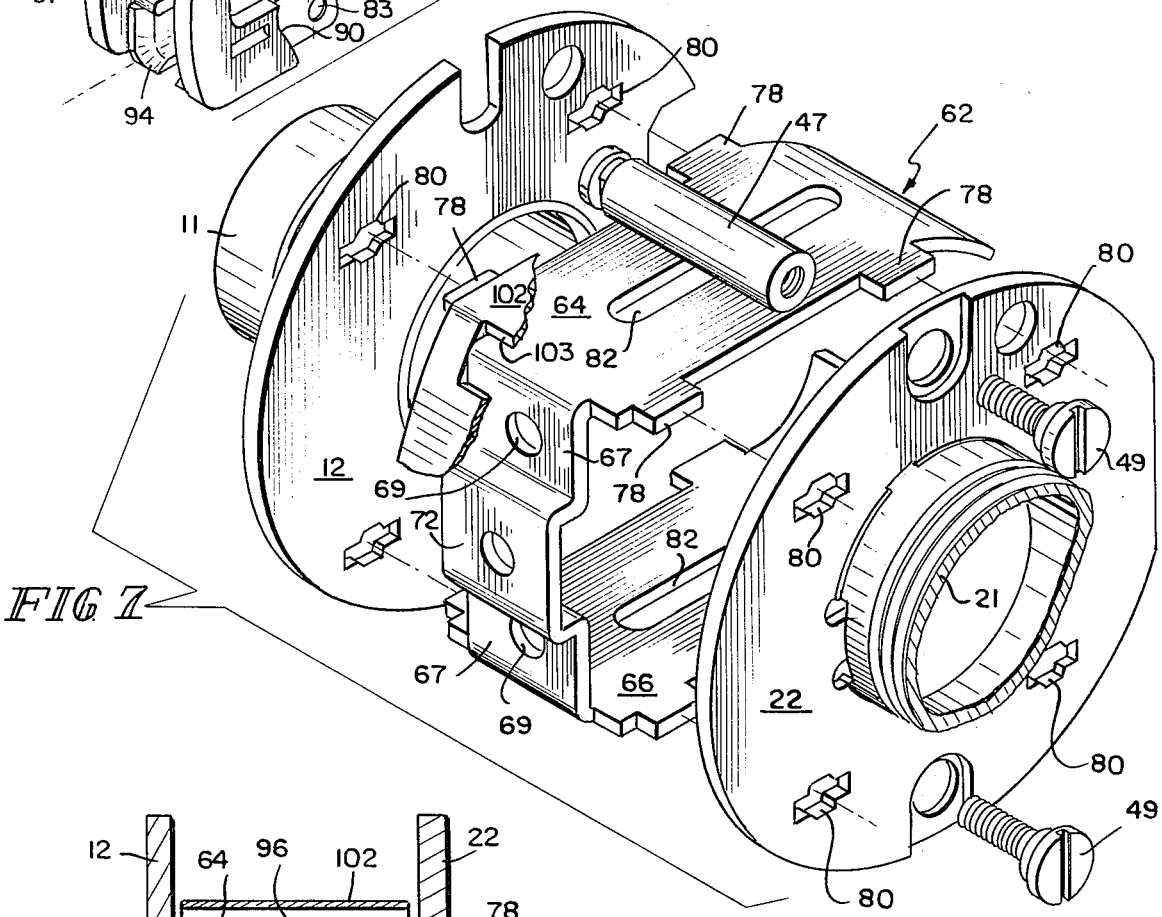
FIG. 7
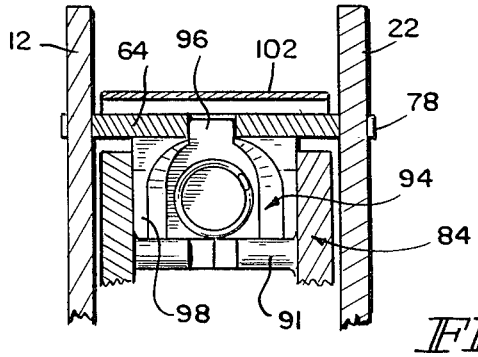
FIG. 4

CYLINDER LOCK RETRACTOR AND CHASSIS ASSEMBLY

This invention relates to a cylindrical lock, and more particularly to a retractor assembly and chassis assembly for such a lock.

In prior cylindrical locks, such as that shown in Best and McCullum U.S. Pat. No. 3,955,387, it has been customary to construct the chassis as a unitary assembly in which the bolt retractor is mounted in a frame member and held therein by end flanges on the hubs where form parts of the knob assemblies and which are fixed against the sides of the frame member. In that patent, the retractor frame member is riveted to the end flange of the inside knob hub. In such an arrangement, the retractor and its biasing springs and associated parts must be mounted individually in the frame member after it has previously been secured to one of the hub flanges, and such parts are held in assembled position by assembling the hub flange of the opposite knob assembly against the frame member. This has several disadvantages, both in the original factory assembly of the cylinder lock chassis and also in field service which may need to be performed on locks already in service.

It is the object of the present invention to provide an improved retractor assembly and an improved chassis assembly which eliminates these disadvantages and provides other advantages over prior practices.

In accordance with the present invention, a retractor assembly is provided in which the retractor is mounted in a frame member and held and guided therein for slidable bolt-retracting movement independently of any parts of the knob assemblies, and which retractor assembly can be preassembled and handled and assembled with other parts as a self-contained unit. This avoids the necessity for relying on the hub flanges or other parts of the opposite knob assemblies to hold the retractor parts in place, and allows both the retractor assembly and the opposite knob assemblies to be preassembled separately to form substantially self-contained units. The resulting three self-containing units can then be finally assembled in a subsequent factory assembly step to provide improved manufacturing procedures, and can also be interchanged and replaced in the field to facilitate field service of the locks. Also, each of the three units can be preassembled in different variations to suit different lock "functions," and the different units can then be selectively combined in the final assembly to provide lock chassis assemblies with the desired functions.

A cylinder lock in accordance with the invention thus comprises a self-contained retractor assembly, preferably including a frame member providing upper and lower walls between which a retractor is mounted and guided by means which is part of the self-contained retractor assembly and which is effective to hold the several parts as a self-contained assembly. This self-contained retractor assembly may then be mounted between the end plates of two opposite assemblies such as the hub flanges of two knob assemblies which are to be mounted at the opposite faces of the door in which the cylinder lock is installed. When the end plates of the two such knob assemblies are clamped against the opposite faces of the retractor assembly, the knob assemblies are held in coaxial relation with each other and such retractor assembly to form the cylinder lock chassis.

The two assemblies at opposite sides of the door may have various functions and forms, depending on the "function" desired for the cylinder lock. Several such functions are known as standard functions in the art. For example, an A-function lock comprises a deadlocking latch bolt operable by both the inside and the outside knob, but the outside knob may be locked against rotation by a push button or the like in the inside knob, and the lock can then be operated from outside only by key operation of a key plug in the center of the outside knob. In this case, the lock will include both inside and outside knob assemblies. Other standard functions may include a knob assembly at only one side of the door, and at the other side of the door the chassis may have only a small thumb-turn device, as for a closet latch, or no means whatever for bolt operation, as on an exit door where operation from outside the door is not intended. In such latter case, the outer face of the retractor assembly may be closed by means which comprises little if any more than a closure plate similar to the end plate of a full knob assembly but including none of the parts required for mounting the knob. Because of this variation, the term "face assembly" is used herein to include any of the various assemblies which may be assembled to the self-contained retractor assembly to form a cylinder lock chassis, ranging from full knob assemblies as used in the A-function lock to the much simpler end plate mounted against the outer face of the retractor assembly where there is no operating means at the outside of the door.

A preferred cylinder lock retractor assembly in accordance with the present invention comprises a frame having generally parallel and symmetrical upper and lower walls respectively above and below the axis of the frame, and having inward-extending jaws at the front to interengage with a bolt housing and to provide an opening for the passage of a bolt-retracting tailpiece. Such walls are connected at the rear by a connecting structure which preferably forms seats for springs to bias the retractor forward, and to bias a catch plate into operating position when such a catch plate is used. The upper and lower walls define a guideway, such as slots of uniform width extending from front to rear, and the retractor carries guide means such as lugs which move in such guideway and which hold the retractor in place in the frame. Preferably, the frame walls are adapted to be clamped edgewise between face assemblies mounted against opposite sides of the retractor assembly and have engagement means at their edges which releasably interengage with locating means on such face assemblies so as to position the two face assemblies in coaxial position with each other and with the retractor assembly. The interengagement means is preferably such that the face assemblies serve to interconnect the upper and lower walls of the frame and lock such walls in fixed operating relation.

The guide lugs by which the retractor is mounted and guided in the guideway are desirably parts of inserts of low-friction material seated in cavities in the edge faces of the retractor and interlocked with the retractor so as to move therewith and be moved thereby, and such inserts preferably form front spring seats to receive the forward ends of the retractor biasing springs.

The accompanying drawings illustrate the invention and show an embodiment of a so-called A-function cylinder lock exemplifying the best mode of carrying out the invention as presently perceived. In such drawings:

FIG. 4 is a partial section taken on the line 4—4 of FIG. 3;

FIG. 5 is a section on the line 5—5 of FIG. 3, showing the retractor assembly in combination with the end plates of two opposite face assemblies, showing the interengagement which is obtained when the self-contained retractor assembly is clamped between such end plates;

FIG. 6 is a perspective view of the retractor shown in the previous Figs., with one of the guide inserts in exploded relation therewith; and FIG. 7 is a perspective view showing the frame of the retractor assembly in relation to face assembly end plates which are clamped against such frame member in final assembly of the chassis.

Figure 1:
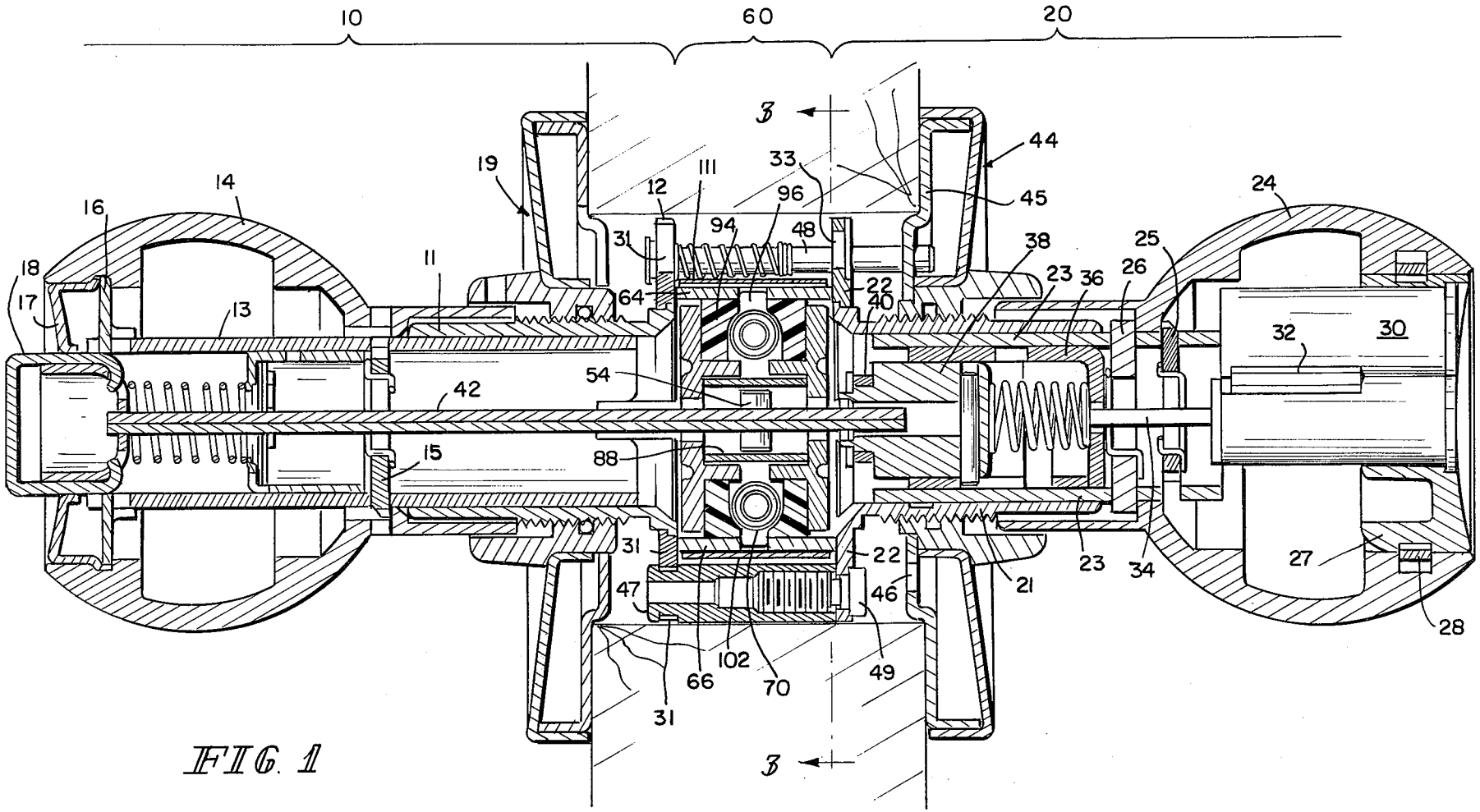
FIG. 1 is a longitudinal section through a cylindrical lock embodying the invention, taken in a vertical plane on the line 1—1 of FIG. 3.

The cylindrical lock shown in the drawings comprises an inside knob face assembly 10 and an outside knob face assembly 20, respectively including end plates 12 and 22 clamped against the side faces of a retractor assembly 60 by clamp studs 32, only one of which is shown.

The inside face assembly 20 comprises a hub 11 fixed at its inner end to a generally circular flange which forms the end plate 12 of the assembly. A knob sleeve 13 is rotatably mounted in the hub 11. In the completed lock, the hub carries a knob 14 at its outer end, retained in place by a spring-actuated retainer 15, and having an inner neck surrounding the outer end of the hub 11. The knob is drivingly connected to the knob sleeve by a drive plate 16 and the outer end of the knob is closed by a face plate 17 containing a push button 18. The inner end of the knob sleeve carries a roll-back 13', shown in FIG. 2. A rose assembly 19 is threaded on the exterior of the hub 11, and is rotatably adjustable thereon so as to press against the inner face of the door in which the cylinder lock is mounted.

The outside face assembly 20 comprises a hub 21 fixed at its inner end to a generally circular flange forming the end plate 22 of the assembly. A knob sleeve 23 is rotatably mounted in the hub 21 and carries a knob 24 at its outer end. This is retained on the knob sleeve by a spring-pressed retainer 25 and is drivingly connected to the knob sleeve by a driver 26. Such driver may be either a positive driver or a torque-releasable driver, as shown in our co-pending application Ser. No. 270,825, filed June 5, 1981. The inner end of the knob sleeve 23 carries a conventional roll-back cam (not shown) for actuating the bolt retractor by rotation of the knob 24.

The outer end of the knob 24 is formed with a large bore in which a circular face plate 27 is rotatably mounted and retained in place by a retainer ring 28 trapped in facing grooves in the face plate and knob. The face plate contains an opening of figure-8 cross section for the reception of a key-removable core 30 of figure-8 cross section, which is held in place by a retainer lug 32 adapted to be controlled by a control key in known manner. The key plug of the core 30 is on the axis of the knob 24, and is connected at its rear to a throw member 34 which extends into driving relation with a key-actuated roll-back sleeve 36 which carries a conventional roll-back cam 37 at its inner end for key actuation of the bolt retractor. For purposes of locking the knob sleeve 23 and the outside knob 24 against rotation, and thus to limit lock actuation from outside to that provided by the key-actuated core 30, a locking lug bushing 38 is slidably mounted within the key-actuated roll-back sleeve 36. This is free to slide axially against a biasing spring and its inner end carries the mounting collar 40 of a locking lug 41. When the locking lug bushing 38 is thrust axially against its biasing spring, the locking lug locks the knob sleeve 23 to the hub 21 in a conventional manner so as to lock the knob 24 against rotation. The locking lug bushing is actuated to its knob-locking position by a control bar 42 actuated by the push button 18 in the inside knob, and the control of such control rod 42 is more fully described below.

A rose assembly 44 is threaded on the outside surface of the hub 21, and is adapted to be rotated into locating and clamping relation with the outside face of the door in which the cylinder lock is mounted. Such rose assembly includes an inside mounting plate 45 which contains a circumferential series of holes 46 opposite the face assembly end plates 12 and 22, and such plates carry a dogging pin 48 adapted to enter one of the holes 46 to secure the outer rose assembly in properly adjusted position to suitably locate the cylinder lock in the door in alignment with the latch bolt assembly.

The two end plates 12 and 22 of the inner and outer face assemblies 10 and 20 are adapted to be clamped together against the sides of the retractor assembly 60 by clamp studs 47 and bolts 49. To this end, the inside end plate 12 is provided with diametrically opposite notches 31 for the reception of the notched end of a stud 47, and the outside end plate 22 is provided with diametrically opposite holes 33 for the reception of the bolts 49 which take into the studs 47.

Figure 2:
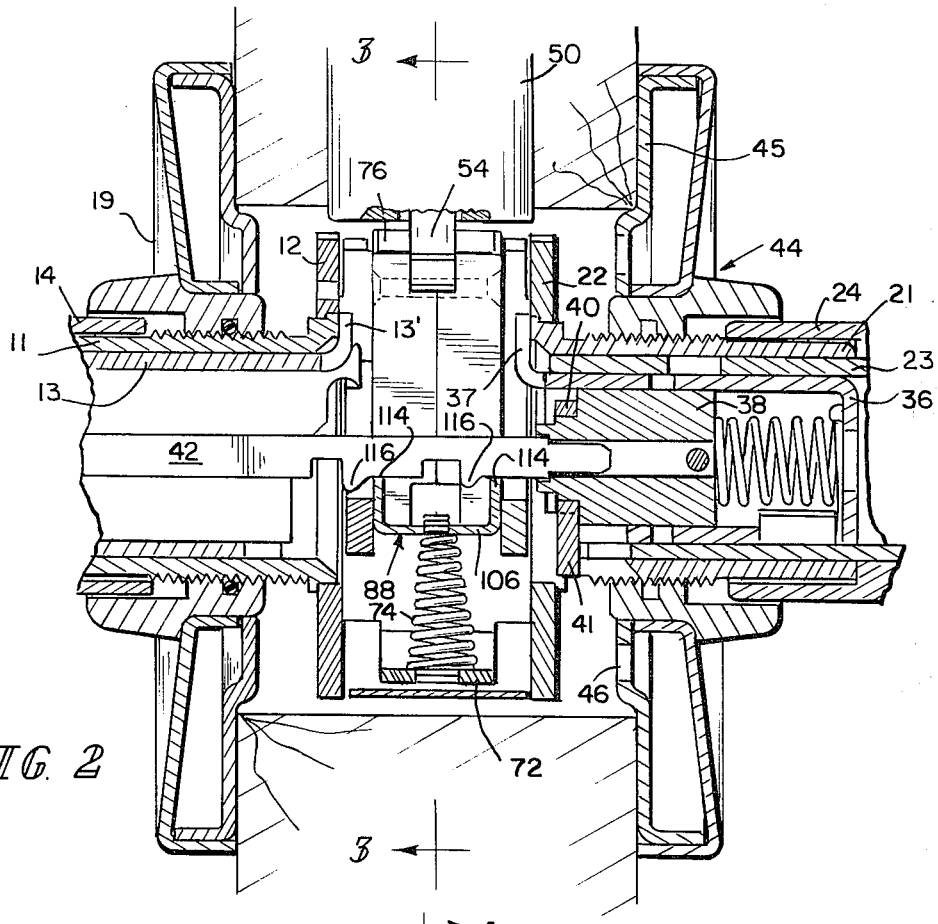
FIG. 2 is a partial section of the lock set shown in FIG. 1, taken in a horizontal plane on the line 2—2 of FIG. 3.
Figure 3:
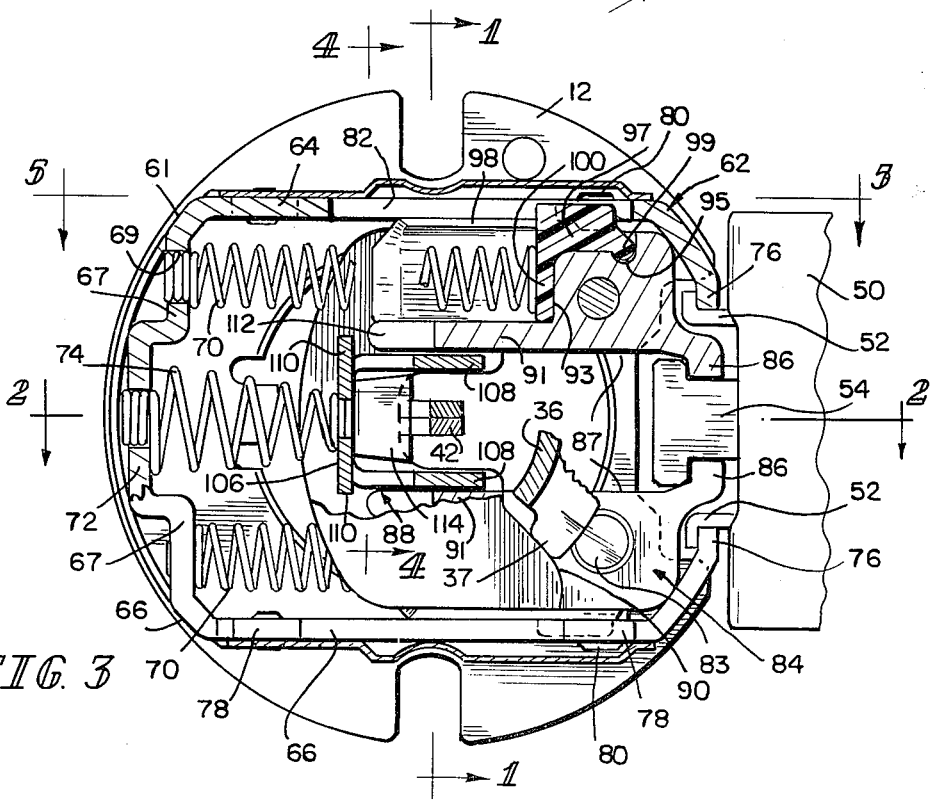
FIG. 3 is a transverse section on the line 3—3 of FIG. 2, showing the retractor assembly in association with the rear end of a latch bolt assembly.

As indicated in FIGS. 2 and 3, the cylinder lock mechanism shown is adapted to interengage with and operate a latch bolt assembly, preferably as shown in our co-pending application Ser. No. 146,670, filed May 5, 1980. Such assembly includes a tubular housing 50 with attachment ears 52 at its rear end adapted to interconnect with the retractor assembly as described below, and a tailpiece 54 which connects the retractor for retracting the bolt.

The retractor assembly 60 forming the central unit against which the end plates 12 and 22 of the face assemblies 10 and 20 are clamped comprises a generally C-shaped frame 62 shown in section in FIG. 3 and in perspective in FIG. 7. Such frame 62 comprises an upper wall 64 and a lower wall 66 in diametrically spaced parallel relation, interconnected at the rear by a rear wall of reduced width. The upper and lower portions 67 of such wall have central openings 69 for the reception of the rear end of retractor-biasing springs 70. The mid-portion 72 of the rear wall is offset rearward and has a central opening for the reception of the rear end of a catch plate spring 74, as shown in FIG. 3. At the forward end of the frame, the upper and lower walls 64 and 66 are bent inward to form jaws 76 for engagement with the ears 52 at the rear of the latch bolt assembly 50, as shown in FIG. 3. The upper and lower frame walls each carry a pair of axially projecting ears 78 for locating engagement in openings 80 in the end plates 12 and 22, so as to locate such end plates and their connected face assemblies in coaxial relation with each other and with the retractor assembly, and to secure the frame walls in fixed relationship. The upper and lower parallel walls 64 and 66 of the frame 62 each contains a guide slot 82 to form a guideway in such walls for a retractor 84 mounted between them.

The retractor 84 shown in side elevation and partial section in FIG. 3 and in perspective in FIG. 6 in the form of a generally C-shaped body conveniently consisting of two identical powdered metal parts clamped together by rivets 83. At its forward end it forms jaws 86 for one-way engagement with the tailpiece 54 of the latch bolt assembly, as shown in FIG. 3. It is open rearward of such jaws to permit the tailpiece to move inward relative to the retractor in the event the lock function provides for such movement. The opening is defined by parallel side faces 87 which serve to define a guideway for a catch plate 88 discussed more fully below. Each side face of the retractor 84 is formed with conventional forward-facing roll-back cams 90 for engagement by roll-backs on the knob sleeves 13 and 23 and the key-actuated roll-back sleeve 36, as indicated in FIG. 3 by the roll-back 37 of such sleeve 36. The upper and lower faces of the retractor each contains a recess 92 for the reception of an insert 94 of low-friction material which carries an upstanding guide lug 96 slidable in the guide slot 82 of the adjacent frame wall 64 or 66. Each recess 92 has a relatively deep reaward portion defined at the bottom by an insert-supporting wall 91 and defined at the front by a vertical thrust face 93. The recess extends forward beyond such thrust face 93 at a relatively shallow depth, and terminates at a somewhat deeper cross slot 95. The insert 94 is correspondingly shaped, with a relatively deep rear portion defined by side walls 98 lying in spaced relation and forming a guide opening for the forward end of the retractor-biasing spring 70, as shown in FIG. 3. The side walls 98 are interconnected at the front of such guideway by a transverse wall 100 which lies in thrust relation with the thrust wall 93 of the retractor body. Such wall 100 joins and forms the rear of a lug-supporting portion 97 which extends forward in supported relation on the bottom of the shallow portion of the recess. A cross bead 99 at the front of the insert portion 97 engages in the cross slot 95 to lock the insert to the retractor body for sliding movement therewith. The upper faces 101 of the side walls 98 of the insert and the lug-supporting portion 97 form a bearing surface adapted to ride on the inner face of the adjacent frame wall 64 or 66, both as a guide and to retain the inserts 94 in place in the recesses 92.

The guide lugs 96 are elongated in the direction of the slots 82 and are firmly supported in the retractor 84 so as to guide its forward end for rectilinear movement in the frame. They serve to positively hold the retractor in the frame so that the assembly is sufficiently self-contained that it can be manufactured, held in stock, and subsequently embodied in a lock chassis as a unitary component. In such a chassis, the retractor is desirably further guided at the rear. To this end, the retractor has rear cheek faces 105 extending rearward from the cams 90 in parallel planes spaced apart slightly less than the edges of the walls 64 and 66. This puts such faces in position to lie in guided relation with the end plates 12 and 22 of face assemblies clamped against the edges of such walls in a final chassis assembly.

The retractor assembly is desirably protected by a cover 102 shown in FIGS. 1–4. This is generally in the form of a C-shaped sheet metal stamping having upper and lower walls overlying the outer faces of the upper and lower walls 64 and 66 of the retractor frame 62 and underlying the clamp studs 47, and having a rear wall interconnecting the upper and lower walls. The upper and lower walls are shaped to clear the path of the guide lug 96 and to interlock with the clamp studs 47. At the juncture between the rear wall and the upper and lower walls, the cover is provided with openings 103 to clear and interfit with the rear corners 61 by which the rear wall 67, 69 of the frame 62 is connected to the upper and lower walls of that frame, as shown in FIGS. 3 and 7.

The retractor assembly 60 is assembled by first inserting guide inserts 94 in the recesses 92 of a retractor 84, and inserting such subassembly between the upper and lower walls 64 and 66 in the frame 62, to locate the guide lugs 96 in the guide slots 82 of the frame 62. The upper and lower walls of the frame 62 may be resiliently sprung apart for this purpose. A cover 102 may be placed over the retractor and frame assembly at this time, or may be added later during chassis assembly. This forms a substantially self-contained unit adapted to be manufactured as such for subsequent assembly between opposite end plates 12 and 22 of two face assemblies, as indicated in FIG. 7. When the retractor assembly unit is assembled between such end plates 12 and 22, the ears 78 on the frame 62 enter the locating openings 80 in the two end plates, and this securely locks the upper and lower walls 64 and 66 of the retractor frame 62 in fixed parallel relation, and locates the end plates 12 and 22 and their connected parts in coaxial spaced relation with each other and the retractor assembly. The end plates 12 and 22 close the sides of the retractor assembly, and position the roll-backs of the two knob sleeves 13 and 23 in operating relationship with the roll-back cams 90 on the retractor. The clamp studs 47 secure the cover 102 on the retractor frame.

When the function of the cylinder lock is such that the inside knob contains a push button 18 and a control rod 42 operable to push the locking lug bushing 38 to its operative position, to the right in FIG. 1, to lock the outside knob 24 against rotation, and such that the control rod is held in its actuated position by means associated with the retractor, the retractor assembly is provided with a catch plate 88 as shown in FIGS. 1–3. The catch plate has a rear wall 106 and upturned side walls 108 slidably received between the inner faces 87 on the walls 91 of the retractor body. The side walls 108 are slotted adjacent their junction with the rear wall 106 to leave outstanding central lugs 110 adapted to enter rearward-open slots 112 in such inner walls 91. The catch plate also has upturned end walls 114 extending toward the control rod 42, and the spring 74 biases the catch plate forward so that such end walls 114 are pressed against the edge of that control rod 42. The control rod 42 carries a pair of cam noses 116 which, in normal position of the control rod 42 as shown in FIGS. 1 and 2, lie inward (toward the inside knob) of such catch-plate end walls 114. The control rod also has notches 118 immediately behind such cam noses 116. The control rod 42 is held generally along the axis of the assembly by engagement of its reduced end in a central hole in the locking lug bushing 38 as shown in FIG. 2. When the push button 18 is pushed inward, shoulders on the control rod 42 thrust lengthwise against the bushing 38 to move it to actuated position, against the force of the biasing spring 39. Concurrently, the cam noses 116 ride against the end walls 114 of the catch plate, and cam such plate rearward against the force of its biasing spring 74 until the cam noses pass such end walls, and the catch plate then moves forward and its end walls engage in the notches 118 behind the cam noses. The catch plate then holds the locking lug bushing 38 in its actuated position, where it causes the outside knob 24 to be locked against rotation.

The catch plate is released by retraction of the retractor 86, as by rotation of the inside knob 14. As the retractor moves rearward from its position shown in FIG. 3, the notches 112 in its inner walls 91 move past the projecting lugs 110 on the rear wall of the catch plate until such lugs reach the bottoms of those notches 112. Further rearward movement of the retractor then carries the catch plate with it through a distance sufficient to disengage the catch plate end walls 114 from behind the cam noses 116, and this releases the control rod for outward movement under the influence of the spring springs which bias the bushing 38 and push button 18 outward.

If the function of the lock is such that the outside knob is permanently locked against rotation or that the control rod and locking lug bushing 38 is actuated by other means, such as a known turn button rather than a push button, and release of the locking lug bushing is effected by rotating the turn button, no catch plate 88 is needed in the retractor assembly, and both the catch plate 88 and its biasing spring 74 are omitted.

In accordance with the present invention, as exemplified by the embodiment shown in the drawings, the retractor assembly 60 is made as a self-contained and unitary subassembly which can be handled as such for subsequent assembly with inside and outside face assemblies 10 and 20, either in subsequent factory assembly operations or in field assembly operations. Likewise, both inside face assemblies and outside face assemblies can be manufactured as self-contained and unitary subassemblies, either like the assemblies 10 and 20 shown or otherwise to provide various other lock functions. The several different face and retractor assemblies can then be selectively assembled to provide complete cylinder lock chassis assemblies having various features and combinations of features to provide various functions for the final cylinder lock. This greatly simplifies and expedites manufacturing operations and also simplifies and expedites field service, since the several subassembly units can be freely selected for original manufacture and can be interchanged and replaced in the field as units by relatively simple steps which require merely clamping appropriate preassembled unitary components together, without the necessity for assembling corresponding chassis portions from their individual parts.

Thus, in manufacture of the cylinder locks shown in the drawings, inside knob face assemblies 10 are manufactured as self-contained units, outside face assemblies 20 are likewise assembled as self-contained units, and retractor assemblies 60 are similarly manufactured as self-contained units. From the stock of these preassembled units, individual lock chassis are then subsequently assembled by clamping the end plates 12 and 22 of the two face assemblies 10 and 20 against the sides of the retractor assembly 60 with clamping studs 47 and 49 in the relationship indicated by the exploded view shown in FIG. 7, so as to form complete chassis assemblies as shown in FIGS. 1–3. A dogging pin 48 for dogging the outside rose assembly 44 in adjusted position may be added at this time or may be preassembled to the inside face assembly 10. Rose assemblies 19 and 44 and knobs 14 and 24 may be added at this time or may be included in the shipment separately from the basic chassis.

The chassis thus completed is mounted in a door in a conventional way. The door is drilled to form a transverse hole to receive the chassis and an edge hole to receive the latch bolt assembly 50. The outside rose assembly 44 is assembled on the outside hub 21, and the chassis is then inserted through the transverse hole to bring the jaws 76 of the retractor frame into engagement with the ears 52 of the latch bolt assembly 50 and to bring the jaws 86 into engagement with the tailpiece 54, in a relationship shown in FIG. 3. The outside rose assembly is adjusted to locate the retractor assembly 60 in alignment with the latch bolt assembly. The inside rose assembly 19 is then assembled on the outside hub 11 and tightened against the inside face of the door. The knob or knobs are then installed by thrusting them inward on the knob sleeves across the knob retainers 15 and 25 to their retained positions. This completes the assembly of the cylinder lock in the door.

What is claimed is:

1. A cylinder lock chassis, comprising a self-contained retractor assembly including a retractor frame, a retractor, and guide means guiding the retractor for rectilinear retractive movement in the frame, said guide means including means for confining the retractor to such retraction movement and for holding the retractor in self-contained relation with the frame, inside and outside face assemblies, each having an end plate, the two plates being separably clamped against the sides of the retractor assembly and interlocked therewith so as to be held in coaxial relation with each other and the retractor assembly, at least one of said face assemblies including a rollback which in the assembled chassis is operative to actuate the retractor through its retractive movement.

2. A cylinder lock chassis as in claim 1 wherein said retractor frame defines a guideway and said guide means comprise low-friction shoes having guide portions slidable in said guideway.

3. A cylinder lock chassis, comprising a self-contained retractor assembly including a frame, a retractor, and guide means guiding the retractor for retractive movement in the frame and holding the retractor in self-contained relation with the frame, inside and outside face assemblies having end plates separably clamped against the sides of the retractor assembly and interlocked therewith so as to be held in coaxial relation with each other and the retractor assembly, at least one of said face assemblies including a rollback which in the assembled chassis is operative to actuate the retractor through its retractive movement, wherein said frame comprises a pair of diametrically spaced parallel walls having parallel slots therein defining a guideway, and said guide means comprises low-friction inserts movable with the retractor and having guide lugs riding in said slots.

4. A cylinder lock as in claim 3 in which said retractor is formed with top and bottom recesses and said inserts are mounted in said recesses and have upstanding position the two face assemblies in coaxial position with each other and with the chassis.

15. A cylinder lock chassis as in claim 14 in which said engagement means are axially projecting tongues adapted to slidably enter openings in the face assemblies.

16. A cylinder lock retractor assembly adapted to be assembled as a substantially self-contained unit between opposite face assemblies, comprising a frame having generally parallel upper and lower walls respectively above and below the axis of the chassis, inward extensions at the front of the walls defining a front opening for passage of a bolt-retracting tailpiece, rearward means interconnecting the walls to hold them in predetermined relation for assembly in a cylinder lock, means defining a retractor guideway extending from front to rear along said walls, a retractor mounted in trapped relation between said walls and for rectilinear sliding movement along said guideway, said walls being adapted to be clamped edgewise between face assemblies mounted against opposite sides of the retractor assembly, and having engagement means at their opposite edges for engagement with locating means on said face assemblies so as to position the two face assemblies in coaxial position with each other and with the chassis, and in which said retractor guideway comprises longitudinal slots in said parallel walls and said retractor has guide lugs thereon slidably engaged in said slots.

17. A cylinder lock retractor assembly as in claim 16 in which said retractor is formed with recesses in its upper and lower faces, inserts of low-friction material mounted in said recesses, said guide lugs being formed on said inserts.

18. A cylinder lock retractor assembly as in claim 17 in which said recesses have a deep rear portion, a thrust face at the front of such deep portions, and a shallower forward portion, said inserts having a rear deep portion received in the deep recess portion, such rear insert portion defining a guide opening to receive the forward end of a biasing spring and having a wall at the front of such opening in thrust relation with said thrust face, said inserts also having a forward shallow portion received in fitted relation in the shallow portion of the recess, said guide lugs being carried by such shallow insert.

19. A cylinder lock retractor assembly as in claim 18 in which said inserts are held in said recesses against lateral movement and have outer faces in sliding relation with the frame walls so as to be held thereby in said cavities.

20. A cylinder lock retractor assembly as in claim 16 in which said retractor has side faces toward the rear thereof in position to be guided by end plates clamped against the edges of the frame walls, and said guide lugs are adjacent the forward end of the retractor.

* * * * *